US005720269A

United States Patent [19]

Saunders

[11] Patent Number: 5,720,269

[45] Date of Patent: Feb. 24, 1998

[54] BOWSTRING SOUND DAMPENER

[76] Inventor: Charles A. Saunders, 8380 - 36th Ave., Columbus, Nebr. 68601

[21] Appl. No.: 698,132

[22] Filed: Aug. 15, 1996

[51] Int. Cl.[6] ..... F41B 5/14

[52] U.S. Cl. ..... 124/86; 124/25.6

[58] Field of Search ..... 124/23.1, 25.6, 124/86, 88, 92

[56] References Cited

U.S. PATENT DOCUMENTS

| | | | |
|---|---|---|---|
| D. 266,179 | 9/1982 | Peck | D22/107 |
| 3,837,327 | 9/1974 | Saunders et al. | 124/92 |
| 4,061,125 | 12/1977 | Trotter | 124/88 X |
| 4,245,612 | 1/1981 | Finlay | 124/89 |
| 4,377,152 | 3/1983 | Saunders | 124/88 |
| 4,440,143 | 4/1984 | Nishioka | 124/86 X |
| 4,461,267 | 7/1984 | Simonds et al. | 124/25.6 |
| 4,570,608 | 2/1986 | Masterfield | 124/89 |
| 4,615,326 | 10/1986 | Rathbun | 124/88 |
| 4,628,892 | 12/1986 | Windedahl et al. | 124/25.6 |
| 4,779,602 | 10/1988 | Hess, Sr. | 124/89 |
| 4,903,678 | 2/1990 | Walker | 124/90 |
| 4,945,666 | 8/1990 | Henry et al. | 42/1.06 |
| 5,002,035 | 3/1991 | Brooks | 124/23.1 |
| 5,065,730 | 11/1991 | Kluver | 124/88 X |
| 5,146,908 | 9/1992 | Larson | 124/88 |
| 5,154,432 | 10/1992 | Saunders | 273/416 |
| 5,339,793 | 8/1994 | Findley | 124/89 |
| 5,385,136 | 1/1995 | Thomas | 124/89 |
| 5,411,009 | 5/1995 | Thompson et al. | 124/89 |
| 5,452,704 | 9/1995 | Winebarger | 124/92 |

*Primary Examiner*—John A. Ricci
*Attorney, Agent, or Firm*—Zarley,McKee,Thomte,Voorhees & Sease; Mark D. Frederiksen

[57] ABSTRACT

A sound dampening apparatus includes a support arm having one end mounted to a bow, and a cushion member on a second end of the support arm and positioned in contact with the bowstring when the string is in the "dead" position. The cushion member is formed of a closed cell foam material which absorbs the energy of movement of the bowstring upon release of the bowstring after launching an arrow, to thereby dampen sound emitted by the string.

23 Claims, 5 Drawing Sheets

BOWSTRING SOUND DAMPENER

TECHNICAL FIELD

The present invention relates generally to archery bows, and more particularly to apparatus for dampening the vibration of the bowstring to thereby silence sound produced during the release of a drawn bowstring.

BACKGROUND OF THE INVENTION

The bowstring on an archery bow will produce a characteristic noise upon release of the bowstring to launch an arrow. This characteristic noise is associated with the vibrational pattern set up by the bowstring, and is colloquially referred to as a "twang". While this sound does not affect the accuracy of a shot, the sound travels faster than the arrow, and may thereby startle the game which is being targeted to reduce the potential for an accurate hit. There have been numerous solutions proposed to this problem, all of them basing their effectiveness on the attachment of some device to the bowstring to thereby "interfere" with the oscillating movement of the bowstring and thereby reduce the associated noise.

However, the major problem with these prior art solutions resides in the fact that attachment of any materials to the bowstring will affect the path and speed of the bowstring, thereby creating an effect on the archer's shot.

SUMMARY OF THE INVENTION

It is therefore a general object of the present invention to provide an improved sound dampening apparatus for a bowstring.

Another object is to provide a bowstring noise dampener which is not attached directly to the bowstring, and does not move with the bowstring.

A further object of the present invention is to provide a sound dampening apparatus for a bowstring which is easily mounted on a bow, and may be utilized on all known bows.

Yet another object is to provide a sound dampening apparatus for a bowstring which is economical to manufacture and simple to use.

These and other objects will be apparent to those skilled in the art.

The sound dampening apparatus of the present invention includes a support arm having one end mounted to a bow, and a cushion member on a second end of the support arm and positioned in contact with the bowstring when the string is in the "dead" position. The cushion member is formed of a material which absorbs the energy of movement of the bowstring upon release of the bowstring after launching an arrow, to thereby dampen sound emitted by the string.

DESCRIPTION OF THE PREFERRED EMBODIMENT

Figure 1:
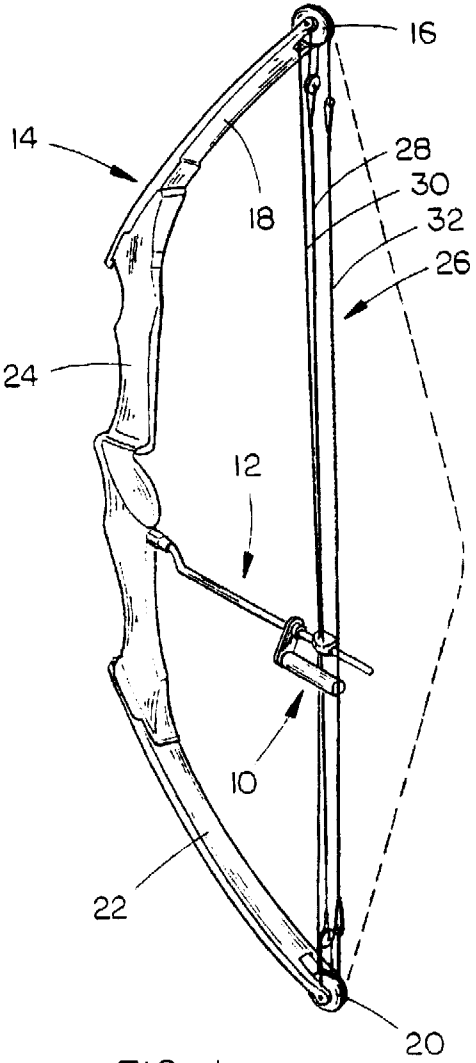
FIG. 1 is a perspective view of compound bow with the bowstring sound dampening apparatus of the present invention installed thereon.

Referring now to the drawings, and which similar or corresponding parts are identified with the same reference numeral, and more particularly to FIG. 1, the sound dampening apparatus of the present invention is designated generally at 10 and is shown attached to a conventional cable guard 12 attached to a compound bow 14. The bow shown is provided with a pair of pulleys, including an upper pulley 16 operably mounted on upper limb 18, and a lower pulley 20 operably mounted on a lower limb 22. Handle riser 24 connects upper and lower limbs 18 and 22 respectively. A multi-strand cable 26, including inner strands 28 and 30 and outer strand 32, is trained through pulleys 16 and 20 in a manner well known in the art.

Figure 2:
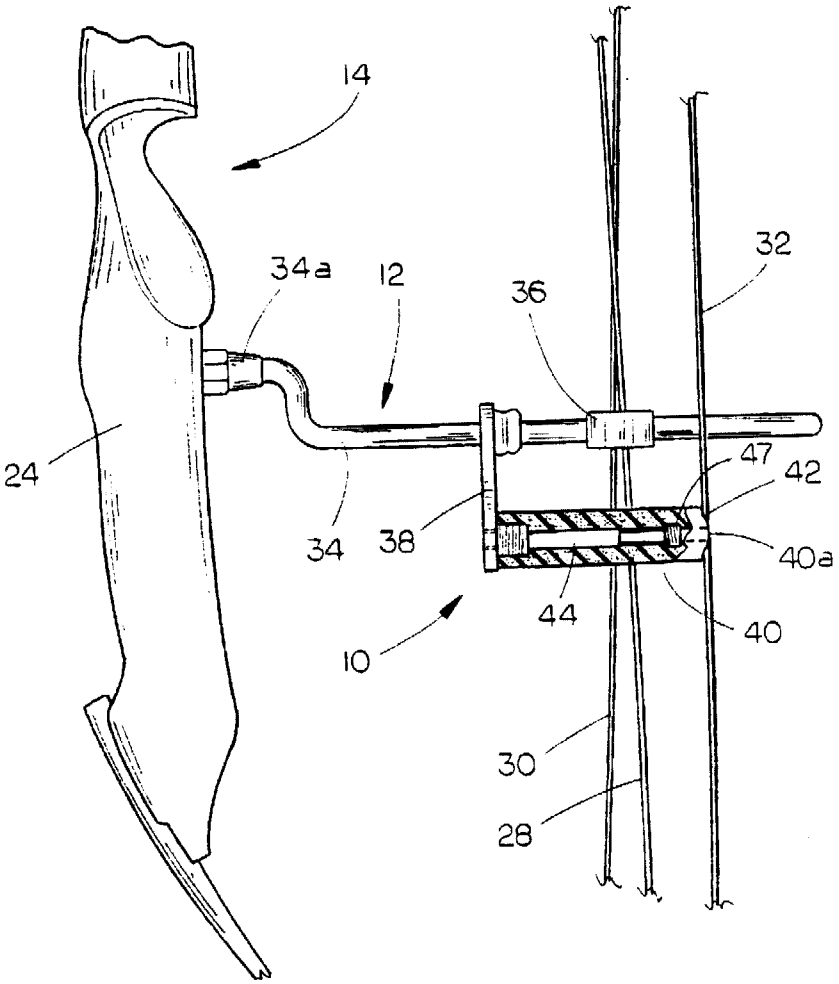
FIG. 2 is an enlarged side elevational view of a portion of the bow with portions of the sound dampening apparatus shown in sectional view.

Referring now to FIG. 2, cable guard 12 includes a generally Z-shaped rod 34 having a forward end **34*a* mounted to handle riser 24. A slide 36 is slidably mounted on rod 34 and holds inner strands 28 and 30 in a plane spaced transversely of outer nocking strand 32. Sound dampening apparatus 10 is shown mounted on rod 34 in FIG. 2. However, it should be noted that sound dampening apparatus 10 may be mounted to bow 14 on handle riser 24, upper limb 18, or lower limb 22, and need not be necessarily attached to cable guard 12**.

Figure 3:
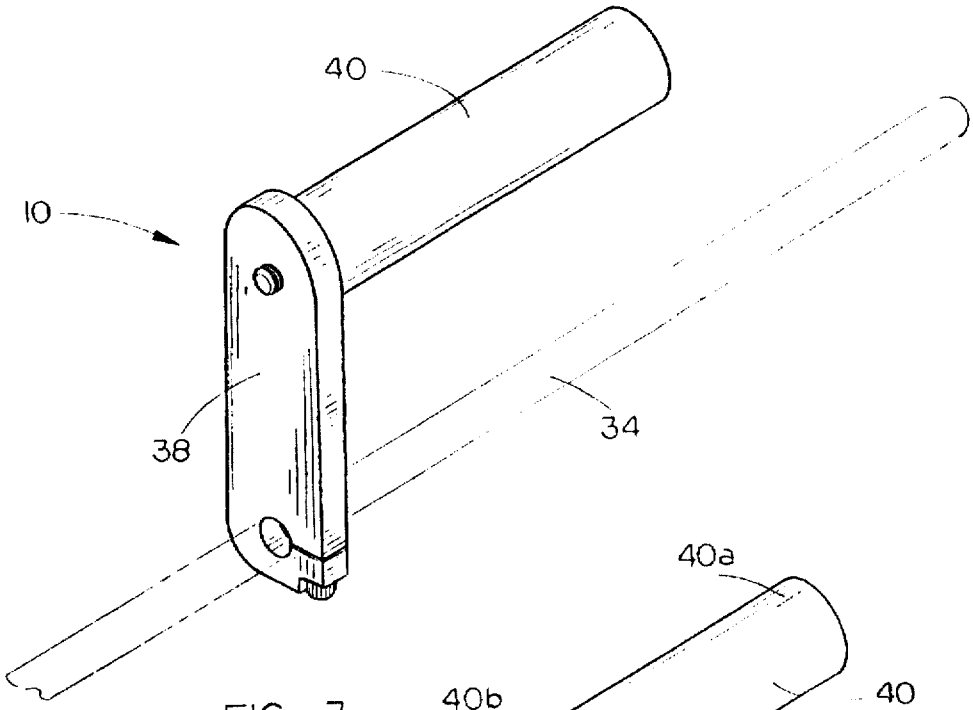
FIG. 3 is a super enlarged perspective view of the sound dampening apparatus.
Figure 4:
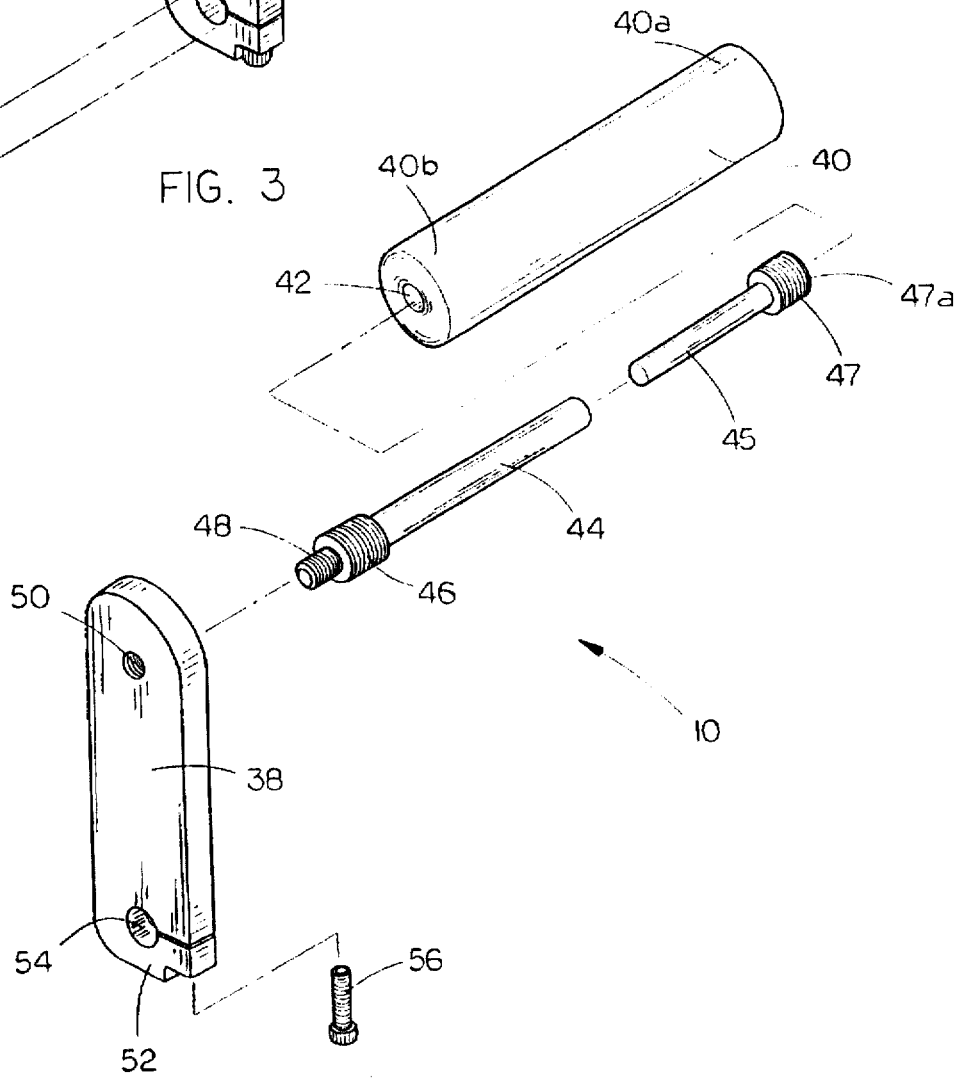
FIG. 4 is a upper enlarged exploded perspective view of the sound dampening apparatus.
Figure 6A:
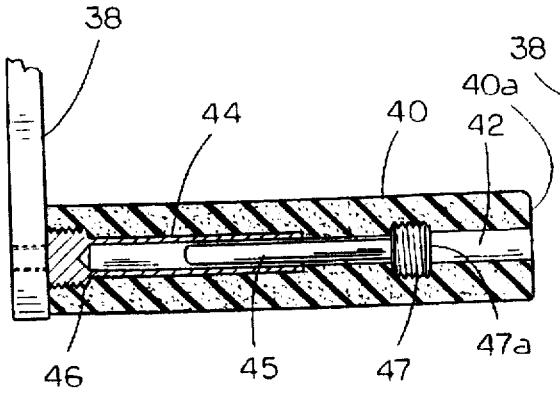
FIG. 6A is a super enlarged sectional view through the sound dampening apparatus.

Referring now to FIGS. 3 and 4, sound dampening apparatus 10 includes a rigid support arm 38 operably connected to cable guard rod 34 (shown in phantom line in FIG. 3), and a cushion member 40 mounted on support arm 38. Preferably, cushion member 40 is a generally cylindrical shaped member formed of a closed cell waterproof foam which is resiliently compressible and provides sound deadening characteristics when an object strikes the cushion member. Cushion member 40 has an aperture 42 extending therethrough along the longitudinal axis thereof. Aperture 42 receives a tubular shaft 44 and plunger 45 therein, to maintain cushion 40 in a generally straight elongated position. A threaded base 46 on the rearward end of tubular shaft 44 has a diameter greater than the outer diameter of shaft 44 and will thread into the rearward end **40*b* of cushion member 40. A threaded stud 48 projects rearwardly from base 46 and engages a threaded hole 50 in one end of support arm 38. A threaded portion 47 is formed on the forward end of plunger 45 and has a diameter greater than the diameter of aperture 42, so as to engage the material of cushion member 40. The rearward end of plunger 45 telescopes within tubular shaft 44. Preferably, a slot or crossed slot is formed in the forward face 47***a* of threaded portion 47, such that the plunger 45 may be rotated by engaging a screwdriver therein and rotating threaded portion 47 in cushion member 40. In this way, the distance between the threaded portion forward surface 47*a* and the forward end 40*a* of cushion member 40 may be quickly and easily adjusted, as shown in FIG. 6A.

A split ring arrangement having a lower jaw 52 forming an aperture 54 between the lower jaw 52 and support arm 38, will grip rod 34 in a desired position upon the threading of screw 56 through jaw 52 and into arm 38, in a conventional fashion.

Figure 5:
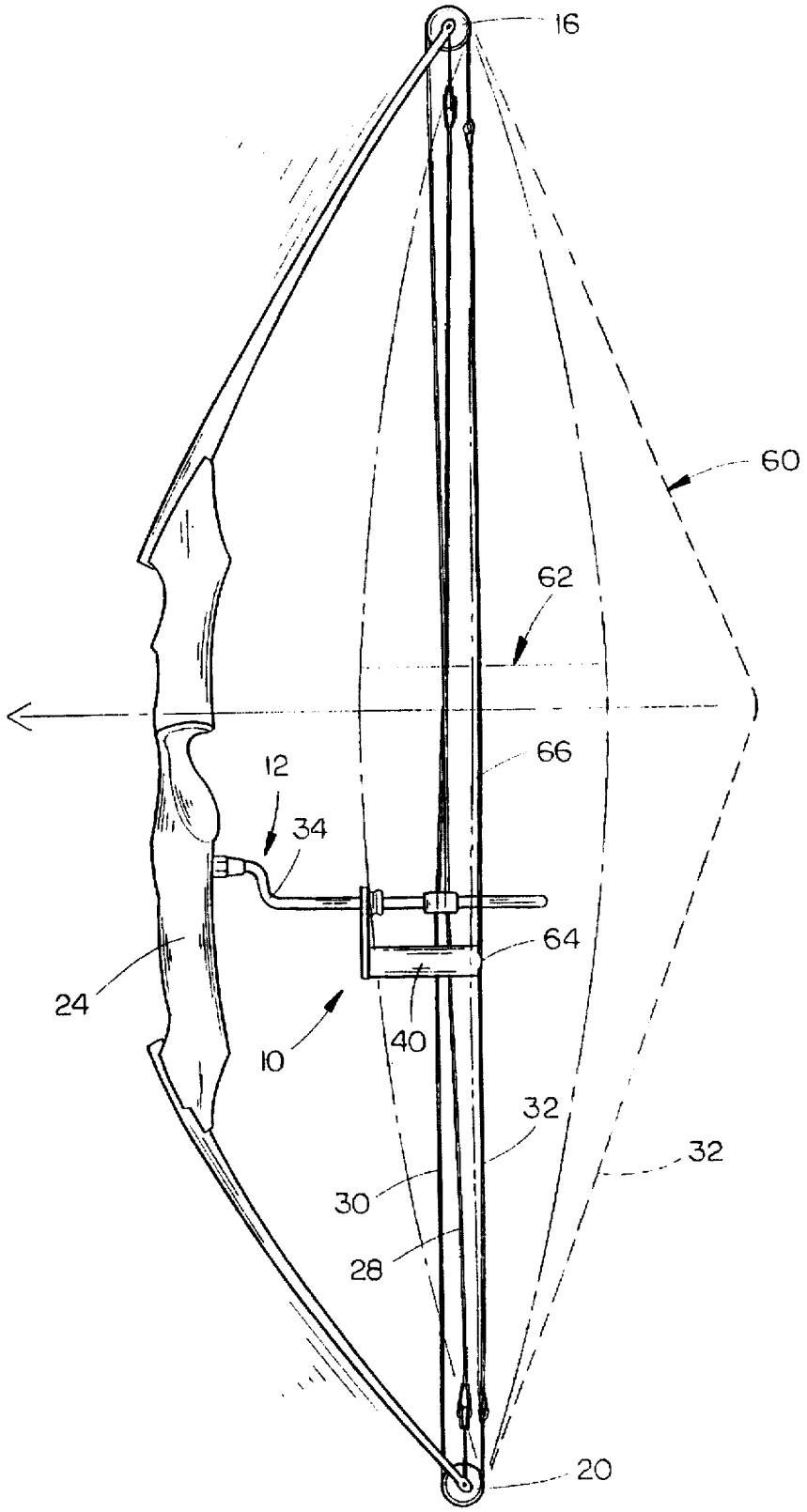
FIG. 5 is a side elevational view of a bow with the sound dampening apparatus thereon.

Referring now to FIG. 5, it can be seen that rod 34 of cable guard 12 is connected to handle riser 24 and projects rearwardly therefrom so as to hold inner strings 28 and 30 transversely away from nocking string 32. Nocking string 32 is shown in the "dead" position in FIG. 5, wherein nocking string 32 is straight, and nonmoving, between upper and lower pulleys 16 and 20. To launch an arrow, nocking string 32 is pulled rearwardly to the "drawn" position shown in dashed lines at 60. Upon release of nocking string 32 the string will follow an oscillating, generally sinusoidal path, having a decreasing amplitude until the string again reaches the "dead" position. The boundaries of the oscillating path are designated generally at 62.

Figure 6B:
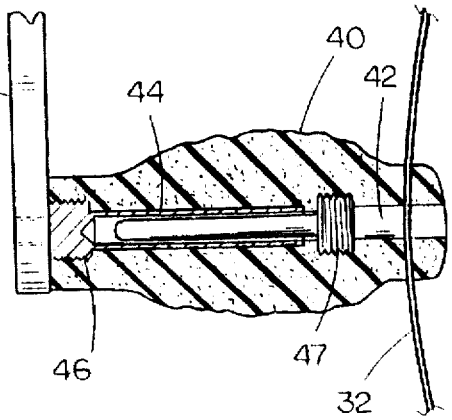
FIG. 6B is a view similar to FIG. 6A, with the sound dampening apparatus compressed to dampen vibrational movement of the nocking string.

Sound dampening apparatus 10 is mounted on rod 34 such that the rearward contact surface 64 of cushion member 40 is in physical contact with nocking string 32 in the "dead" position. Cushion member 40 is oriented with its longitudinal axis generally perpendicular to nocking string 32 in the "dead" position. Once nocking string 32 is drawn rearwardly to drawn position 60 and released, it will immediately contact the rearward contact surface 64 of cushion member 40 and compress the cushion member 40 between threaded portions 46 and 47 as shown in FIG. 6B. The cushion material of cushion member 40 immediately dampens the vibration of nocking string 32, to thereby eliminate the "twang" by preventing the movement of string 32 along oscillation path 62. It has been found that the use of a foam material dampens the vibrational movement of the string in two ways. First, the compression of cushion member 40 along its longitudinal axis and second, as the cells of the foam material are compressed, they actually "grip" or close around the string as it contacts the material, thereby forming a clamping action on the string. While a small "thud" sound occurs with the use of sound deafening apparatus 10, the noise is much quieter and lower frequency, and therefore less likely to startle or alarm game since low frequency sound is less directional.

Figure 7:
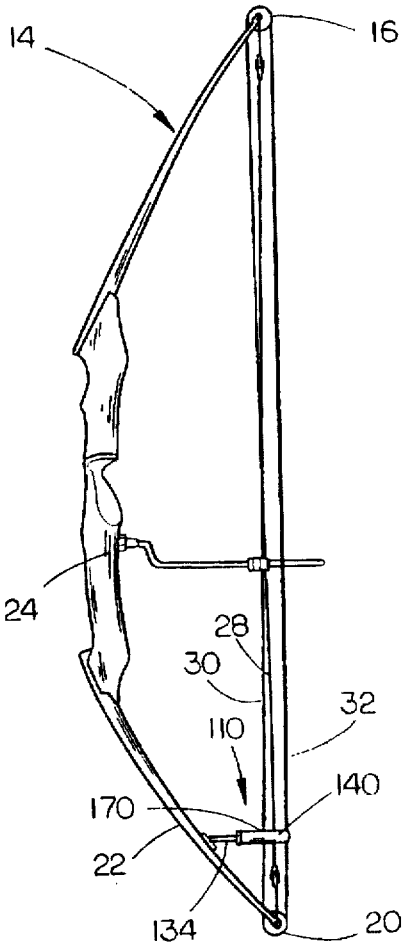
FIG. 7 is a side elevational view of a bow with a second embodiment of the sound dampening apparatus thereon.
Figure 8:
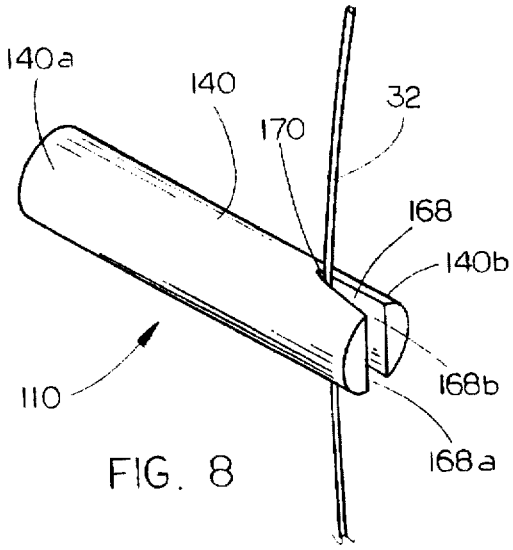
FIG. 8 is an enlarged perspective view of the second embodiment of the sound dampening apparatus.

Referring now to FIGS. 7 and 8, a second embodiment of the sound dampening apparatus is designated generally at 110 and includes a generally cylindrical cushion member 140 projecting rearwardly from a support rod 134 which is affixed to the lower limb 22 of bow 14. Cushion member 140 has a V-shaped notch 168 formed in the rearward end 140*b* thereof, which extends forwardly towards cushion member forward end 140*a*. A valley 170 forms the forward end of notch 168 and serves to stop movement of nocking string 32. As shown in FIG. 7, cushion member 140 is mounted on rod 134 with valley 170 located in adjacent contact with nocking string 32, when nocking string 32 is in the "dead" position. When nocking string 32 is drawn rearwardly and released, it will enter notch 168 and be gripped by the side walls 168*a* and 168*b* of notch 168 as it reaches valley 170, to thereby grip or "clamp" onto nocking string 32 and dampen the vibration thereof. While it is believed that virtually any material would be effective for cushion member 140, the best results have been achieved with a resilient rubber material, which provides a compressible "grip" on the string, or with a closed cell foam material. Obviously, cushion member 140 could be mounted in the same fashion as cushion member 40 of the first embodiment of the invention.

Figure 9:
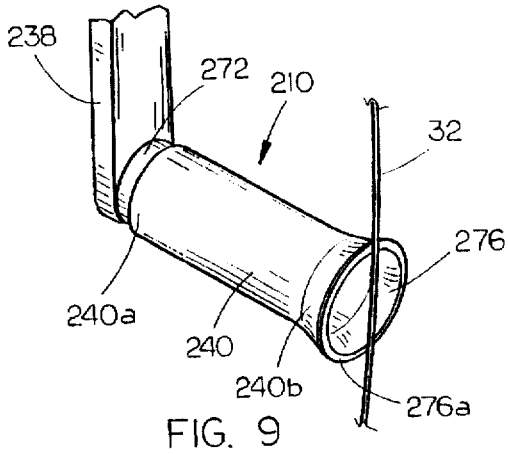
FIG. 9 is a perspective view of a third embodiment of the sound dampening apparatus.
Figure 10:
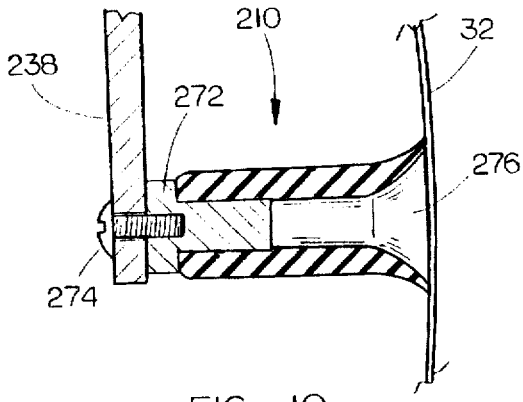
FIG. 10 is a sectional view through the sound dampening apparatus of FIG. 9.

A third embodiment of the sound dampening apparatus is designated generally at 210 in FIGS. 9 and 10 and is mounted to a support arm 238 so as to extend from a bow. Sound dampening apparatus 210 includes a hollow tubular cushion member 240 mounted at a forward end 240*a* to a base 272 which is in turn connected to support arm 238 by a screw 274. The rearward end 240*b* of cushion member 240 expands radially outwardly to form a cone 276 with a flared end. As with the previous embodiments of the invention, sound dampening apparatus 210 is mounted with cushion member 240 located such that a rearward face 276*a* of valve 276 is located in adjacent contact with nocking string 32, when nocking string 32 is in the "dead" position. As nocking string 32 is released from the drawn position, it will contact bell 276 and cause the flared end of the cone to bend or "roll" radially outwardly, thereby dampening the vibration of nocking string 32. The best results have been found in utilizing a hard rubber material for cushion member 240, which provides sufficient resilience to flex or "roll" when contacted by string 32.

Figure 11:
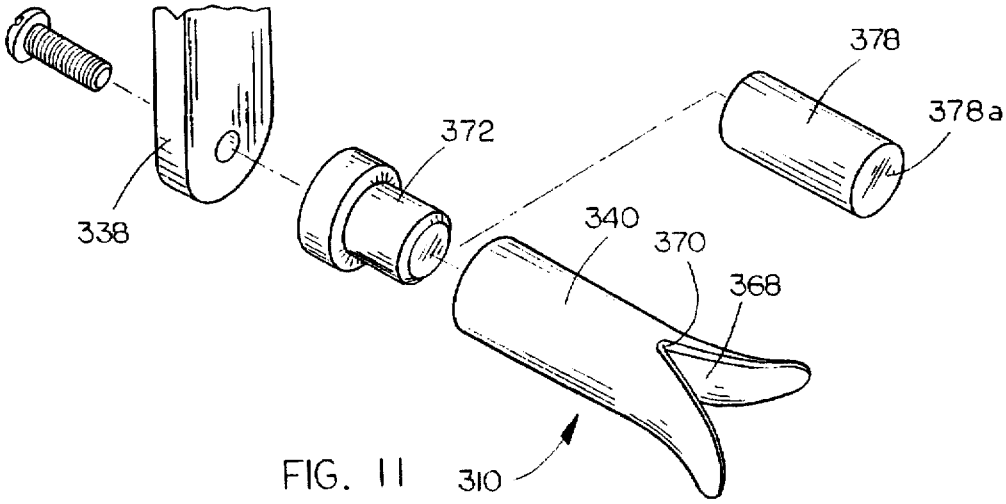
FIG. 11 is an enlarged exploded perspective view of a fourth embodiment of the sound dampening apparatus.
Figure 12:
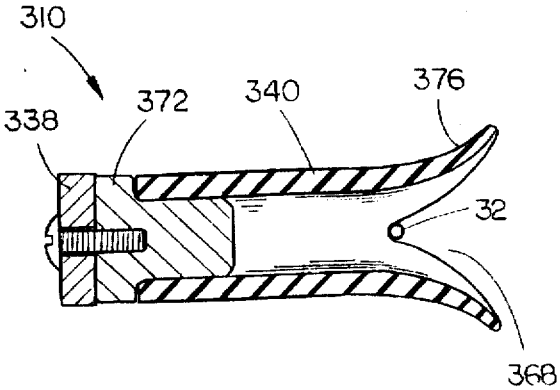
FIG. 12 is a sectional view through portions of the apparatus of FIG. 11.
Figure 13:
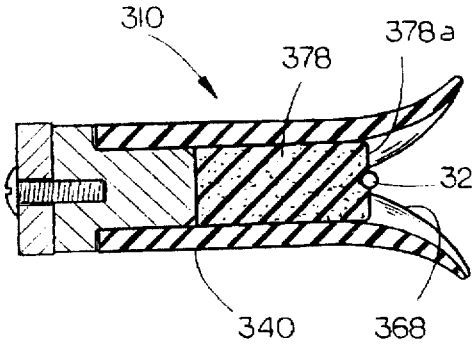
FIG. 13 is a sectional view through the sound dampening apparatus of FIG. 11.

A fourth embodiment of the sound dampening apparatus is disclosed in FIGS. 11, 12 and 13, and designated generally at 310. Sound dampening apparatus 310 is essentially a combination of the second and third embodiments of the invention, and includes a tubular cushion member 340 which is flared at the rearward end to form a cone 376, and then cut along the longitudinal axis to form a notch 368 in cone 376. The forward end of cushion member 340 is connected via a base 372 to a support arm 338, in a fashion similar to the third embodiment of the invention. Cushion member 340 is located such that the valley 370 is oriented adjacent to and in contact with the nocking string 32, when the nocking string is in the "dead", as shown in FIG. 12. In this way, the flared cone 376 will flex and roll outwardly simultaneously with the "clamping" characteristic of notch 368 as nocking string 32 enters notch 368 upon being released from the drawn position.

An auxiliary dampening pad 378 may be provided for additional dampening effect. As shown in FIGS. 11 and 13, auxiliary pad 378 is cylindrical in shape and has a diameter to fit snugly within the tubular cushion member 340. Preferably, auxiliary pad 378 is formed of a resilient compressible material, such as a closed cell foam material. Auxiliary pad 378 is located within cushion member 340 with a rearward face 378*a* located slightly rearwardly of valley 370 in notch 368. In this way, hocking string 32 will first contact auxiliary pad 378 for preliminary sound dampening, prior to reaching valley 370 and the secondary dampening provided by notch 368.

Whereas the invention has been shown and described in connection with the preferred embodiment thereof, many modifications, substitutions and additions may be made which are within the intended broad scope of the appended claims. For example, single string bows would not utilize a cable guard, and therefore the support arm of the sound dampening apparatus would be attached directly to the bow, with the cushion member oriented in contact with the single string of the bow. In addition, the sound dampening apparatus could be attached to either of the upper or lower limbs 18 or 22 rather than the handle riser 24, without departing from the spirit of the invention.

I claim:

1. A sound dampening apparatus for a bow, comprising:

a support arm having first and second ends;

means on the first end of the support arm for connecting the support arm to a bow;

a cushion member of vibration dampening material mounted on the second end of said arm, for contacting a bowstring and dampening vibrational movement thereof;

said cushion member having a longitudinal axis and formed of a material which is resiliently compressible along the longitudinal axis; and rigid support means within said cushion member for maintaining said cushion member generally straight along its longitudinal axis during compression, while permitting compression of the cushion member along its longitudinal axis.

2. The apparatus of claim 1, wherein said cushion member includes an aperture formed through said cushion member along its longitudinal axis, and wherein said support means includes a shaft extending rearwardly from the second end of the support arm and journaled within said aperture, said shaft extending less than the entire length of the cushion member.

3. The apparatus of claim 2, wherein at least a portion of said shaft is slidably mounted in said aperture, to permit slidable compression of the cushion member along the shaft.

4. A sound dampening apparatus for a bow, comprising:

a support arm having first and second ends;

means on the first end of the support arm for connecting the support arm to a bow;

a cushion member of vibration dampening material mounted on the second end of said arm, for contacting a bowstring and dampening vibrational movement thereof;

said cushion member having a longitudinal axis and being formed of a closed cell foam material which is resiliently compressible along the longitudinal axis;

said cushion member including an aperture formed therethrough along the longitudinal axis thereof;

a tubular shaft extending rearwardly from the second end of the support arm, journaled within a forward portion of said aperture; and a plunger having a forward end and telescoping within a rearward end of the tubular shaft, and a rearward end projecting rearwardly therefrom;

said plunger having means on the rearward end thereof for engaging the cushion member within the aperture and moving with the cushion member, such that the cushion member will compress between the plunger rearward end engagement means and the support arm as the plunger telescopes within the tubular shaft.

5. The apparatus of claim 4, wherein said plunger rearward end engagement means includes a threaded portion formed on the plunger, and further comprising a tool-receiving notch in a rearward face of the plunger rearward end, for receiving a tool to rotate the plunger and threads and thereby adjust the distance between the plunger rearward face and the cushion member rearward end.

6. In combination:

a bow having a bowstring extending between free ends of the bow;

said bow string having a path of movement comprising:

a "dead" position wherein the string is straight and unmoving;

a "drawn" position wherein the string is pulled rearwardly away from the bow; and an "oscillation" position wherein the string oscillates in generally sinusoidal curves between the bow ends after release from the drawn position, until resuming the "dead" position; and a said sound dampening apparatus connected to the bow for preventing the oscillation position of the bow string, comprising:

a support arm having first and second ends, the first end connected to the bow and the second end projecting freely therefrom;

a cushion member mounted on the second end of the support arm formed of a vibration dampening material, said cushion member having forward and rearward ends, and a contact surface on the rearward end thereof; and said sound dampening apparatus mounted between said bow and bowstring with said cushion member contact surface in contact with said bowstring when the bowstring is in the "dead" position;

said cushion member having a longitudinal axis between the forward and rearward ends and being resiliently compressible along the longitudinal axis;

said cushion member being mounted on said bow with the longitudinal axis oriented generally perpendicularly to the string in the "dead" position.

7. The combination of claim 6, further comprising rigid support means within said cushion member for maintaining said cushion member generally straight along its longitudinal axis during compression, while permitting compression of the cushion member along its longitudinal axis.

8. The combination of claim 7, wherein said cushion member includes an aperture formed through said cushion member along its longitudinal axis, and wherein said support means includes a shaft extending forwardly from the second end of the support arm and journaled within said aperture, said shaft extending less than the entire length of the cushion member.

9. The combination of claim 8, wherein at least a forward portion of said shaft is slidably mounted in said aperture, to permit slidable compression of the cushion member along the shaft.

10. The combination of claim 6, wherein said cushion member longitudinal axis lies generally within a plane formed by the string and the bow.

11. In combination:

a bow having a bowstring extending between free ends of the bow;

said bow string having a path of movement comprising:

a "dead" position wherein the string is straight and unmoving;

a "drawn" position wherein the string is pulled rearwardly away from the bow; and an "oscillation" position wherein the string oscillates in generally sinusoidal curves between the bow ends after release from the drawn position, until resuming the "dead" position; and a sound dampening apparatus connected to the bow for preventing the oscillation position of the bow string, comprising:

a support arm having first and second ends, the first end connected to the bow and the second end projecting freely therefrom;

a cushion member mounted on the second end of the support arm formed of a vibration dampening material, said cushion member having forward and rearward ends, and a contact surface on the rearward end thereof; and said sound dampening apparatus mounted between said bow and bowstring with said cushion member contact surface in contact with said bowstring when the bowstring is in the "dead" position;

said cushion member having a longitudinal axis and formed of a material which is resiliently compressible along the longitudinal axis;

said cushion member including an aperture formed therethrough along the longitudinal axis thereof;

a tubular shaft extending rearwardly from the second end of the support arm, journaled within a forward portion of said aperture; and a plunger having a forward end and telescoping within a rearward end of the tubular shaft, and a rearward end projecting rearwardly therefrom;

said plunger having means on the rearward end thereof for engaging the cushion member within the aperture and moving with the cushion member, such that the cushion member will compress between the plunger rearward end engagement means and the support arm as the plunger telescopes within the tubular shaft.

12. The combination of claim 11, wherein said plunger rearward end engagement means includes a threaded portion formed on the plunger, and further comprising a tool-receiving notch in a rearward face of the plunger rearward end, for receiving a tool to rotate the plunger and threads and thereby adjust the distance between the plunger rearward face and the cushion member rearward end.

13. A sound dampening apparatus for a bow, comprising:

a support arm having first and second ends;

means on the first end of the support arm for connecting the support arm to a bow; and a cushion member mounted on the second end of the support arm and having means for dampening vibrational movement of a bowstring upon contact of the bowstring therewith;

said cushion member being an elongated member having forward and rearward ends;

said means for dampening the bowstring including a generally V-shaped notch extending forwardly into the rearward end of the member, for receiving the bowstring in a valley of the notch;

said cushion member being formed of a resilient compressible material which will partially surround and grip the bowstring within the valley of the notch.

14. A sound dampening apparatus for a bow, comprising:

a support arm having first and second ends;

means on the first end of the support arm for connecting the support arm to a bow; and a cushion member mounted on the second end of the support arm and having means for dampening vibrational movement of a bowstring upon contact of the bowstring therewith;

said cushion member being an elongated tubular member of resilient, flexible material having forward and rearward ends, and said means for dampening the bowstring including the rearward end of the tubular member being flared radially outwardly in the shape of a cone.

15. The apparatus of claim 14, wherein said dampening means further comprises a V-shaped notch formed in diametric sides of the flared end of the cushion member and extending forwardly to a valley, for receiving the bowstring in the diametric valleys of the notches.

16. The apparatus of claim 15, wherein said dampening means further comprises an auxiliary pad of compressible material inserted within the tubular member and having a rearward end projecting rearwardly beyond the valleys of the notches.

17. In combination:

a bow having a bowstring extending between free ends of the bow;

said bow string having a path of movement comprising:

a "dead" position wherein the string is straight and unmoving;

a "drawn" position wherein the string is pulled rearwardly away from the bow; and an "oscillation" position wherein the string oscillates in generally sinusoidal curves between the bow ends after release from the drawn position, until resuming the "dead" position; and a sound dampening apparatus connected to the bow for preventing the oscillation position of the bow string, comprising:

a support arm having first and second ends, the first end connected to the bow and the second end projecting freely therefrom;

a cushion member mounted on the second end of the support arm formed of a vibration dampening material, said cushion member having forward and rearward ends, and a contact surface on the rearward end thereof; and said sound dampening apparatus mounted between said bow and bowstring with said cushion member contact surface in contact with said bowstring when the bowstring is in the "dead" position;

said cushion member including an aperture formed therethrough along the longitudinal axis thereof;

a tubular shaft extending rearwardly from the second end of the support arm, journaled within a forward portion of said aperture; and a plunger having a forward end and telescoping within a rearward end of the tubular shaft, and a rearward end projecting rearwardly therefrom;

said plunger having means on the rearward end thereof for engaging the cushion member within the aperture and moving with the cushion member, such that the cushion member will compress between the plunger rearward end engagement means and the support arm as the plunger telescopes within the tubular shaft.

18. The combination of claim 17, wherein said plunger rearward end engagement means includes a threaded portion formed on the plunger, and further comprising a tool-receiving notch in a rearward face of the plunger rearward end, for receiving a tool to rotate the plunger and threads and thereby adjust the distance between the plunger rearward face and the cushion member rearward end.

19. In combination:

a bow having a bowstring extending between free ends of the bow;

said bow string having a path of movement comprising:

a "dead" position wherein the string is straight and unmoving between the free ends of the, bow;

a "drawn" position wherein the string is pulled rearwardly away from the bow; and an "oscillation" position wherein the string oscillates in generally sinusoidal curves between the bow ends after release from the drawn position, until resuming the "dead" position; and a sound dampening apparatus connected to the bow for preventing the oscillation position of the bow string, comprising:

a support arm having first and second ends, the first end connected to the bow and the second end projecting freely therefrom;

a cushion member mounted on the second end of the support arm formed of a vibration dampening material, said cushion member having forward and rearward ends, and a contact surface on the rearward end thereof; and said sound dampening apparatus mounted between said bow and bowstring with said cushion member contact surface in contact with said bowstring when the bowstring is in the "dead" position;

said cushion member being an elongated member having forward and rearward ends, and said means for dampening the bowstring including a generally V-shaped notch extending forwardly into the rearward end of the member, for receiving the bowstring in a valley of the notch, the valley of the notch forming said contact surface.

20. The combination of claim 19, wherein said cushion member is formed of a resilient compressible material which will grip the bowstring within the valley of the notch.

21. In combination:

a bow having a bowstring extending between free ends of the bow;

said bow string having a path of movement comprising:

a "dead" position wherein the string is straight and unmoving;

a "drawn" position wherein the string is pulled rearwardly away from the bow; and an "oscillation" position wherein the string oscillates in generally sinusoidal curves between the bow ends after release from the drawn position, until resuming the "dead" position; and a sound dampening apparatus connected to the bow for preventing the oscillation position of the bow string, comprising:

a support arm having first and second ends, the first end connected to the bow and the second end projecting freely therefrom;

a cushion member mounted on the second end of the support arm formed of a vibration dampening material, said cushion member having forward and rearward ends, and a contact surface on the rearward end thereof; and said sound dampening apparatus mounted between said bow and bowstring with said cushion member, contact surface in contact with said bowstring when the bowstring is in the "dead" position;

said cushion member being an elongated tubular member of resilient, flexible material having forward and rearward ends, and said means for dampening the bowstring including the rearward end of the tubular member being flared radially outwardly in the shape of a cone.

22. In combination:

a bow having a bowstring extending between free ends of the bow;

said bow string having a path of movement comprising:

a "dead" position wherein the string is straight and unmoving;

a "drawn" position wherein the string is pulled rearwardly away from the bow; and an "oscillation" position wherein the string oscillates in generally sinusoidal curves between the bow ends after release from the drawn position, until resuming the "dead" position; and a sound dampening apparatus connected to the bow for preventing the oscillation position of the bow string, comprising:

a support arm having first and second ends, the first end connected to the bow and the second end projecting freely therefrom;

a cushion member mounted on the second end of the support arm formed of a vibration dampening material, said cushion member having forward and rearward ends, and a contact surface on the rearward end thereof; and said sound dampening apparatus mounted between said bow and bowstring with said cushion member contact surface in contact with said bowstring when the bowstring is in the, "dead" position;

said cushion member being an elongated tubular member of resilient, flexible material, having forward and rearward ends, and further comprising a V-shaped notch formed in diametric sides of the rearward end for receiving the bowstring within diametric valleys of the notches, the notch valleys forming the contact surface.

23. In combination:

a bow having a bowstring extending between free ends of the bow;

said bow string having a path of movement comprising:

a "dead" position wherein the string is straight and unmoving;

a "drawn" position wherein the string is pulled rearwardly away from the bow; and an "oscillation" position wherein the string oscillates in generally sinusoidal curves between the bow ends after release from the drawn position, until resuming tile "dead" position; and a sound dampening apparatus connected to the bow for preventing the oscillation position of the bow string, comprising:

a support arm having first and second ends, the first end connected to the bow and the second end protecting freely therefrom;

a cushion member mounted on the second end of the support arm formed of a vibration dampening material, said cushion member having forward and rearward ends, and a contact surface on the rearward end thereof; and said sound dampening apparatus mounted between said bow and bowstring with said cushion member contact surface in contact with said bowstring when the bowstring is in the "dead" position;

said cushion member being an elongated tubular member of resilient flexible material, having forward and rearward ends;

a V-shaped notch formed in diametric sides of the rearward end having diametric valleys formed at forward ends of the notches; and an auxiliary pad of compressible material inserted within the tubular member and having a rearward end projecting rearwardly beyond said valleys, said pad rearward end forming said contact surface.

* * * * *